US010993035B2

(12) United States Patent
Børresen

(10) Patent No.: US 10,993,035 B2
(45) Date of Patent: Apr. 27, 2021

(54) MAGNET SYSTEM FOR AN ELECTROMECHANICAL TRANSDUCER

(71) Applicant: UPPER LEVEL APS, Aalborg (DK)

(72) Inventor: Michael Børresen, Aarhus (DK)

(73) Assignee: Upper Level APS, Aarlborg (DK)

( * ) Notice: Subject to any disclaimer, the term of this patent is extended or adjusted under 35 U.S.C. 154(b) by 0 days.

(21) Appl. No.: 16/593,464

(22) Filed: Oct. 4, 2019

(65) Prior Publication Data

US 2020/0112793 A1 Apr. 9, 2020

(30) Foreign Application Priority Data

Oct. 4, 2018 (DK) ..... PA 2018 00678

(51) Int. Cl.

| | |
|---|---|
| ***H04R 9/02*** | (2006.01) |
| ***H01F 7/08*** | (2006.01) |
| ***H01F 27/28*** | (2006.01) |
| ***H04R 7/16*** | (2006.01) |
| ***H04R 9/04*** | (2006.01) |
| ***H04R 9/06*** | (2006.01) |

(52) U.S. Cl.

CPC ..... *H04R 9/025* (2013.01); *H01F 7/081* (2013.01); *H01F 27/28* (2013.01); *H04R 7/16* (2013.01); *H04R 9/045* (2013.01); *H04R 9/06* (2013.01); *H04R 2400/11* (2013.01)

(58) Field of Classification Search

CPC ..... H04R 2209/024; H04R 9/025; H04R 2209/021; H04R 2209/022

See application file for complete search history.

(56) References Cited

U.S. PATENT DOCUMENTS 4,628,154 A * 12/1986 Kort ..... H04R 9/025 335/231
5,371,806 A * 12/1994 Kohara ..... H04R 9/025 381/420

(Continued)

FOREIGN PATENT DOCUMENTS

DE 19725373 A1 * 12/1998 ..... H04R 9/025
DE 19725373 A1 12/1998

(Continued)

OTHER PUBLICATIONS

Search Report from Danish Patent App. No. PA 2018 00678 (dated Apr. 3, 2019).

*Primary Examiner* — Ryan Robinson
(74) *Attorney, Agent, or Firm* — Jones Robb, PLLC

(57) ABSTRACT

A magnet system (100) for an electromechanical transducer has a first set (2) of magnets and a second set (4) of magnets. The first set (2) of magnets has a first, inner annular magnet (6) and a first outer, annular magnet (8), and the second set (4) of magnets has a second, inner annular magnet (10) and a second, outer annular magnet (12). The first, inner annular magnet (6) is arranged in the interior of the first outer annular magnet (8), and the second inner annular magnet (10) is arranged in the interior of the second outer annular magnet (12). The magnetic polarity in respect of the first, inner annular magnet (6), the first, outer annular magnet (8), the second, inner annular magnet (10), and of the second, outer annular magnet (12) has a direction (Y) corresponding to a direction perpendicular to the annular extension (X) of the magnets.

17 Claims, 6 Drawing Sheets

(56) References Cited

U.S. PATENT DOCUMENTS

| | | | | |
|---|---|---|---|---|
| 6,774,510 | B1 * | 8/2004 | Moro | H02K 41/0356 310/12.24 |
| 6,940,992 | B2 * | 9/2005 | Stiles | H04R 9/025 381/412 |
| 7,031,489 | B2 * | 4/2006 | Amino | H04R 9/025 381/412 |
| 7,317,810 | B2 * | 1/2008 | Ohashi | H04R 9/025 381/421 |
| 10,194,246 | B2 * | 1/2019 | Morgan | H01F 7/0289 |
| 2006/0251286 | A1 * | 11/2006 | Stiles | H04R 9/025 381/421 |
| 2008/0170744 | A1 * | 7/2008 | Button | H04R 9/025 381/412 |
| 2010/0172534 | A1 | 7/2010 | Lemarquand et al. | |
| 2015/0139478 | A1 * | 5/2015 | Hyde | H04R 1/00 381/401 |
| 2015/0271605 | A1 * | 9/2015 | Zhang | H04R 9/043 381/401 |
| 2018/0070182 | A1 | 3/2018 | Graber | |
| 2019/0313192 | A1 * | 10/2019 | Miyata | H04R 1/02 |
| 2020/0037078 | A1 * | 1/2020 | Scheek | H04R 9/063 |

FOREIGN PATENT DOCUMENTS

| | | | |
|---|---|---|---|
| JP | 1155788 | A | 2/1999 |
| KR | 20090028877 | A | 3/2009 |

* cited by examiner

MAGNET SYSTEM FOR AN ELECTROMECHANICAL TRANSDUCER

This application claim priority under 35 U.S.C. § 119 to Danish App. No. PA 2018 00678, filed 4 Oct. 2018, the entirety of which is incorporated by reference herein.

FIELD OF THE DISCLOSURE

The present disclosure relates in general to the field of electromechanical transducers.

More specifically the present disclosure relates in a first aspect to a magnet system for an electromechanical transducer.

In a second aspect the present disclosure relates to an electromechanical transducer comprising a magnet system according to the first aspect in combination with a coil of an electrically conducting material.

In a third aspect the present disclosure relates to a speaker unit comprising an electromechanical transducer according to the second aspect in combination with a diaphragm.

BACKGROUND OF THE DISCLOSURE

Electromechanical transducers are devices which provides for producing a mechanical movement in a response to an electric signal being provided thereto. Accordingly, electromechanical transducers find application in all sorts of technology where it is desired to control a mechanical actuation with an electric signal.

Many types of electromechanical transducers exploit the phenomenon that when an electric wire is conducting an electric current in the vicinity of a magnetic field, the wire experiences a force being exerted on the wire.

As the force exerted on the wire will have a magnitude commensurate with the magnitude of the current flowing in the wire and with the magnitude of the magnetic field, it is clear that for some applications it is desirable to provide the magnetic field as strong as possible.

One type of technology in which electromechanical transducers have found widely use is the field of loudspeakers.

A loudspeaker includes a magnetic system typically including one or more magnets in combination with iron elements arranged in a configuration so that an air gap is provided through which magnetic flux from the magnets is directed. In the air gap is arranged a voice coil which is provided with the electric signal to be transformed into sound, optionally via a cross-over filter.

A diaphragm is connected to the voice coil. As the diaphragm includes a relatively large area, an electric signal provided to the voice coil will by virtue of induction translate into a movement of the diaphragm, the magnitude of which will mimic the electric signal being provided to the voice coil. Thereby the electric signal provided to the voice coil will translate into sonic waves propagating through the air from the diaphragm.

The design of magnet systems for loudspeakers has for many years adhered to rather conservative concepts.

These concepts generally follow the following principles. The magnet systems of prior art loudspeakers include an annular magnet being arranged between a T-yoke and a top plate. The T-yoke includes a base plate and a cylindrical extension, extending therefrom. The top plate includes a circular central hole. In this way an air gap for a voice coil is formed between the cylindrical extension of the T-yoke and the hole in the top plate.

The annular magnet is having its magnetic polarity aligned in a direction parallel to the extension of the T-yoke. Hereby magnetic flux follows from the magnet to the top plate through the air gap and into the extension of the T-yoke, further through the base plate of the T-yoke and back to the magnet.

This conservative design current used in the design of the magnet system for loudspeakers in turn suffers from a number of drawbacks.

One of these drawbacks is that the design itself of the magnet system does not allow attaining a desirable high magnetic flux density in the air gap between the top plate and the pole of the T-yoke. A non-optimum magnetic flux density in the air gap of the pole piece implies a inefficient speaker in the sense that only a small amount of power being supplied to the voice coil translates into mechanical movement of the diaphragm of the speaker.

Another drawback of the prior art T-yoke type magnet systems is the inherent asymmetric magnetic field encountered in the air gap and especially in the vicinity of the borders of the air gap. Such asymmetry implies various types of undesirably distortion of the movement of the voice coil, in relation to the electric signal supplied thereto.

Yet another disadvantage of the above type of magnet systems for loudspeakers is that an undesirably high inductance of the voice coil, is encountered in the air gap of the magnet system. Such high inductance leads to a non-linear response of the voice coil in relation to the electric signal supplied thereto.

Accordingly, a need persists to improve the design of magnet systems for electromechanical transducers and in particular in relation to uses in acoustic drivers for loudspeakers.

The present disclosure in its various aspect seeks to meet this need.

Accordingly, it is an objective of the present disclosure to provide devices and uses which meet these needs.

SUMMARY

These objectives can be fulfilled according to the first, the second, and the third aspect of the present disclosure.

Accordingly, the present disclosure relates in a first aspect to a magnet system for an electromechanical transducer; wherein said magnet system includes a first set of magnets and a second set of magnets;

- wherein said first set of magnets includes a first, inner annular magnet and a first outer, annular magnet;
- wherein said second set of magnets includes a second, inner annular magnet and a second, outer annular magnet;
- wherein said first, inner annular magnet is arranged in the interior of said first outer annular magnet;
- wherein said second inner annular magnet is arranged in the interior of said second outer annular magnet;
- wherein the magnetic polarity in respect of said first, inner annular magnet, said first, outer annular magnet, said second, inner annular magnet and of said second, outer annular magnet is having a direction corresponding to a direction perpendicular to the annular extension of said magnets;
- wherein said magnet system includes a first pole piece arrangement, said first pole piece arrangement includes a first, inner annular pole piece and a first, outer annular pole piece, wherein said first, inner annular pole piece is arranged within the interior of said first, outer annular pole piece;

wherein said first pole piece arrangement is being arranged between said first set of magnets and said second set of magnets;

wherein the magnetic polarity of said first, inner annular magnet is opposite to the magnetic polarity of said first, outer annular magnet;

wherein the magnetic polarity of said first, inner annular magnet is opposite to the magnetic polarity of said second, inner annular magnet; and wherein the magnetic polarity of said first, outer annular magnet is opposite to the magnetic polarity of said second, outer annular magnet; and wherein said first, inner annular magnet and said first outer, annular magnet are having geometries and dimensions so that a first magnet air gap is being present between said first, inner annular magnet and said first, outer annular magnet; and/or wherein said second, inner annular magnet and said second, outer annular magnet are having geometries and dimensions so that a second magnet air gap is being present between said second, inner annular magnet and said second, outer annular magnet; and/or wherein said said first, inner annular pole piece and said first, outer annular pole piece are having geometries and dimensions so that a first pole piece air gap is being present between said first, inner annular pole piece and said first, outer annular pole piece;

characterized in that said first, inner pole piece and said first, outer pole piece are being made from a non-ferromagnetic material.

In a second aspect the present disclosure relates to an electromechanical transducer including a magnet system according to the first aspect of the present disclosure in combination with one or more coil(s) of an electrically conducting material, wherein said coil(s) is/are being arranged in one or more of the first pole piece air gap and optionally also in a second pole piece air gap, if present, of said magnet system.

In a third aspect the present disclosure relates to a speaker unit including an electromechanical transducer according to the second aspect of the disclosure and furthermore including a diaphragm, wherein said diaphragm is mechanically coupled to said coil(s).

The present disclosure in its various aspects provides for magnet systems, transducers and speaker units which result in a more accurate response in relation to an electric signal being provided, thereby reducing the degree of non-linearity and various types of distortion.

These advantages of the magnet system according to the disclosure are particularly profound when the magnet system is used in acoustic drivers for loudspeakers.

It has been found that designing a magnet system according to the first aspect of the present disclosure, wherein the first, inner pole piece and the first, outer pole piece are being made from a non-ferromagnetic material, an extremely low inductance can be attained in respect of an electric coil being accommodated in the air gap between that first, inner pole piece and that first, outer pole piece, compared to a similar situation in which the first, inner pole piece and the first, outer pole piece are made from a ferromagnetic material.

A very low inductance in a voice coil for a speaker unit is highly desirably because such a speaker unit will provide for an improved response curve and enhanced dynamics for the speaker.

Moreover, a very low inductance in a voice coil will imply reduced resonance-impedance variation, thus leading to lower phase shift and impedance variation in an amplifier coupled to that speaker unit.

Accordingly, in particularly preferred embodiments the present disclosure provides for electrodynamic transducers to be used in speaker units and loudspeakers, and having improved properties.

DETAILED DESCRIPTION OF EXEMPLARY EMBODIMENTS

Figure 1:
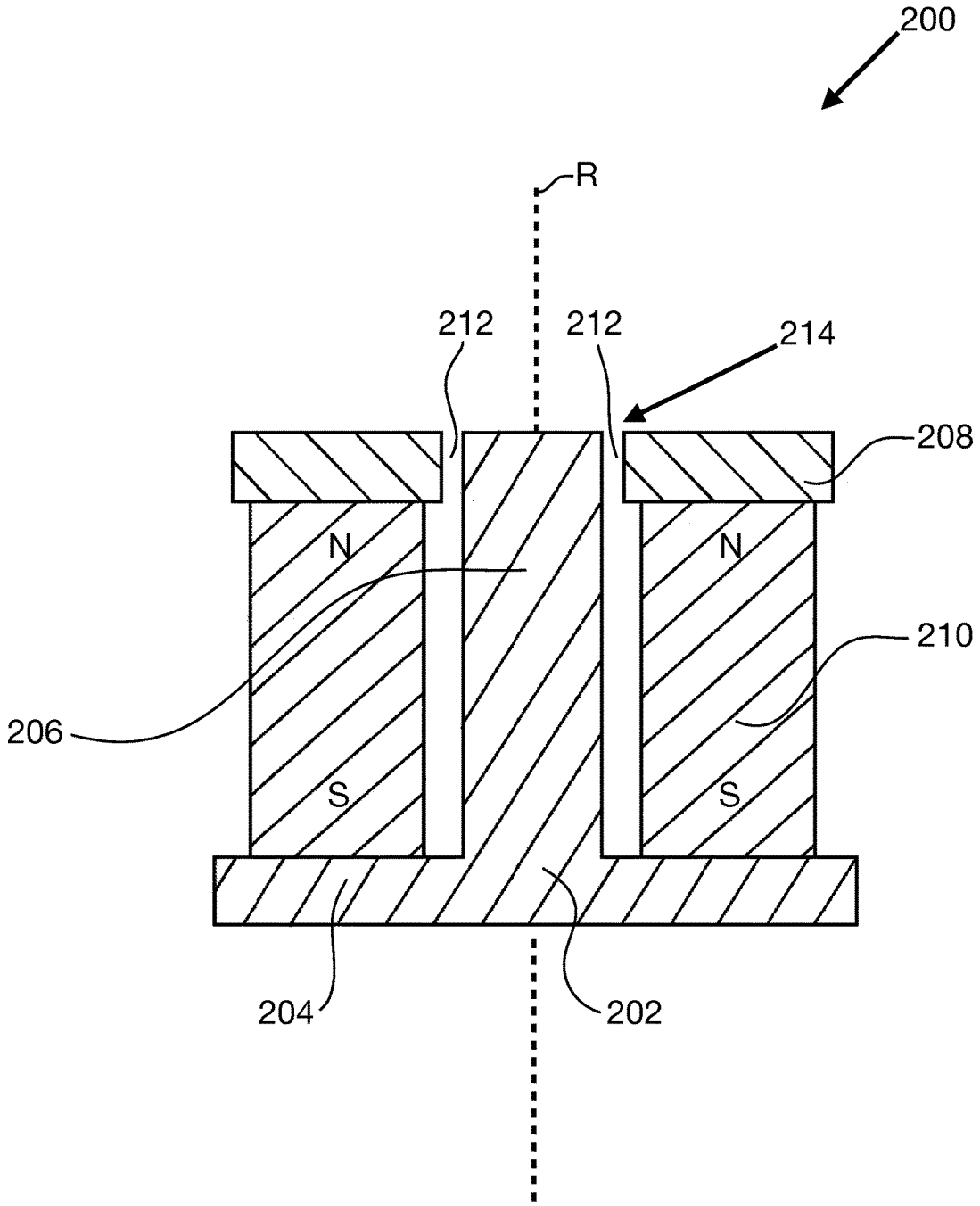
FIG. 1 is a cross-sectional view illustrating a prior art magnet system for a loudspeaker unit.

A First Aspect of the Present Disclosure

The present disclosure relates in a first aspect to a magnet system for an electromechanical transducer; wherein said magnet system includes a first set of magnets and a second set of magnets;

wherein said first set of magnets includes a first, inner annular magnet and a first outer, annular magnet;

wherein said second set of magnets includes a second, inner annular magnet and a second, outer annular magnet;

wherein said first, inner annular magnet is arranged in the interior of said first outer annular magnet;

wherein said second inner annular magnet is arranged in the interior of said second outer annular magnet;

wherein the magnetic polarity in respect of said first, inner annular magnet, said first, outer annular magnet, said second, inner annular magnet and of said second, outer annular magnet is having a direction corresponding to a direction perpendicular to the annular extension of said magnets;

wherein said magnet system includes a first pole piece arrangement, said first pole piece arrangement includes a first, inner annular pole piece and a first, outer annular pole piece, wherein said first, inner annular pole piece is arranged within the interior of said first, outer annular pole piece;

wherein said first pole piece arrangement is being arranged between said first set of magnets and said second set of magnets;

wherein the magnetic polarity of said first, inner annular magnet is opposite to the magnetic polarity of said first, outer annular magnet;

wherein the magnetic polarity of said first, inner annular magnet is opposite to the magnetic polarity of said second, inner annular magnet; and wherein the magnetic polarity of said first, outer annular magnet is opposite to the magnetic polarity of said second, outer annular magnet; and wherein said first, inner annular magnet and said first outer, annular magnet are having geometries and dimensions so that a first magnet air gap is being present between said first, inner annular magnet and said first, outer annular magnet; and/or wherein said second, inner annular magnet and said second, outer annular magnet are having geometries and dimensions so that a second magnet air gap is being present between said second, inner annular magnet and said second, outer annular magnet; and/or wherein said said first, inner annular pole piece and said first, outer annular pole piece are having geometries and dimensions so that a first pole piece air gap is being present between said first, inner annular pole piece and said first, outer annular pole piece;

characterized in that said first, inner pole piece and said first, outer pole piece are being made from a non-ferromagnetic material.

Accordingly, the magnet system of the first aspect of the present disclosure relates to a magnet system including a first set of magnets and a second set of magnets and a pole piece arrangement, wherein the pole piece arrangement is sandwiched between the first set of magnets and the second set of magnets. Air gaps are provided between the inner and outer magnets of each set of magnets, and between the inner pole piece and the outer pole piece. In this or these air gaps can be accommodated a coil of an electrically conducting wire, thereby forming a electromechanical transducer.

The high symmetry of the magnet system provides, in relation to prior art magnet system certain advantages as explained further in sections below.

In one embodiment of the magnet system according to the first aspect of the present disclosure, the magnet system is a magnet system for an acoustic driver, such as for a loudspeaker.

The magnet system of the present disclosure is particularly well-suited for use in for an acoustic driver, such as in a loudspeaker.

In one embodiment of the magnet system according to the first aspect of the present disclosure, the first magnet air gap, said second magnet air gap and/or said first pole piece air gap independently is having an extension in a direction perpendicular to the direction of said magnetic polarities, of 0.1-6 mm, such as 0.2-5 mm, e.g. 0.3-4 mm, such as 0.4-5 mm, for example 0.5-4 mm, such as 0.6-3 mm, such as 0.7-2 mm, for example 0.8-1 mm.

Such "radial" extensions of the air gap have proven suitable for the intended purposes of the present disclosure.

In one embodiment of the magnet system according to the first aspect of the present disclosure two or more of the first magnet air gap, the second magnet air gap and/or the first pole piece air gap independently is having an extension, in a direction perpendicular to the direction of said magnetic polarities, of equal magnitude.

In one embodiment of the magnet system according to the first aspect of the present disclosure the magnet system includes fixation means, for fixing, relative to each other, the first, inner annular magnet, the first, outer annular magnet; the second, inner annular magnet, the second, outer annular magnet; the first, inner annular pole piece and the first, outer annular pole piece; wherein the fixation means optionally including bolts, nuts, bushings and/or glue.

Hereby the structural integrity of the pole piece is assured.

In one embodiment of the magnet system according to the first aspect of the present disclosure the first, inner annular magnet, the first, outer annular magnet; the second, inner annular magnet and the second, outer annular magnet independently are magnets selected from the group including: ferrite magnets, samarium-cobalt magnets, alnico magnets, neodymium-iron-boron magnets or other commercially available types of magnets.

Such types of magnetic materials have proven beneficial in relation to the present disclosure.

In one embodiment of the magnet system according to the first aspect of the present disclosure the first, inner annular pole piece and the first, outer annular pole piece independently are being made from a non-ferromagnetic metal or alloy; such as copper, aluminium or silver, or an alloy thereof, such as bronze or brass. These materials have proved well-suited for use in the magnet system of the disclosure.

It is preferred that the first, inner annular pole piece and the first, outer annular pole piece independently is/are having an electrical conductivity (o) of $3.5\times10^7$ S/m or more, such as $3.75\times10^7$ S/m or more, such as $4.0\times10^7$ S/m or more, for example $4.25\times10^7$ S/m or more, such as $4.5\times10^7$ S/m or more, e.g. $4.75\times10^7$ S/m or more, such as $5.0\times10^7$ S/m or more, for example $5.25\times10^7$ S/m or more, such as $5.5\times10^7$ S/m or more, for example $5.75\times10^7$ S/m or more, such as $6.0\times10^7$ S/m or more or $6.25\times10^7$ S/m or more.

The first, inner pole piece and the first, outer pole piece may be made of the same type of material or different types of materials.

In one embodiment of the magnet system according to the first aspect of the present disclosure the first, inner annular magnet, the second, inner annular magnet and the first, inner annular pole piece each independently are having a cylindrical inner surface and/or a cylindrical outer surface.

Such geometries are common for magnet systems and pole pieces for use in a speaker unit.

In one embodiment of the magnet system according to the first aspect of the present disclosure the first, outer annular magnet, the second, outer annular magnet and the first, outer annular pole piece each independently are having a cylindrical inner surface and/or a cylindrical outer surface.

Such geometries are common for magnet systems and pole pieces for use in a speaker unit.

In one embodiment of the magnet system according to the first aspect of the present disclosure the inner surface and/or the outer surface of one or more of the first, inner annular magnet, the second, inner annular magnet; the first, outer annular magnet; the second, outer annular magnet; the first, inner annular pole piece and/or the first, outer annular pole piece is/are having a circular, an elliptical, or a rectangular cross section; or having a cross-section in the form of a rounded rectangle.

Such geometries are common for magnet systems and pole pieces for use in a speaker unit.

In one embodiment of the magnet system according to the first aspect of the present disclosure the first, inner annular magnet is concentrically arranged within the first, outer annular magnet; and/or the second, inner annular magnet is concentrically arranged within the second, outer annular magnet; and/or the first, inner annular pole piece is concentrically arranged within said first, outer annular pole piece.

Such concentrically arrangement may provide for a symmetrical geometry of the corresponding air gaps.

In one embodiment of the magnet system according to the first aspect of the present disclosure the and in respect of one or both magnets of the first set of magnets and/or the second set of magnets is having a magnetic flux density, at a pole surface thereof, of 0.1-1.4 T, such as 0.2-1.3 T, for example 0.3-1.2 T, such as 0.4-1.1 T, e.g. 0.5-1.0 T, such as 0.6-0.9 T or 0.7-0.8 T.

In one embodiment of the magnet system according to the first aspect of the present disclosure the magnets of said first set of magnets and of the second set of magnets provide a magnetic flux density in said first pole piece air gap of 0.5-1.4 T, such as 0.6-1.3 T, for example 0.7-1.2 T, e.g. 0.8-1.1 T or 0.9-1.0 T.

Such flux densities provide for efficient response of a coil of an electrically conducting material when the coil is accommodated in the first pole piece air gap, such as when used in an electromechanical transducer, such as a speaker unit.

In one embodiment of the magnet system according to the first aspect of the present disclosure the maximum extension, in a direction perpendicular to the direction of the magnetic polarity of the magnets, of one or more of the first, inner annular magnet, the second, inner annular magnet; the first, outer annular magnet; the second, outer annular magnet; the first, inner annular pole piece and/or the first, outer annular pole piece independently is/are selected from the ranges: 0.1-30 cm, such as 0.2-29 cm, e.g. 0.4-28 cm, such as 0.6-27 cm, such as 0.7-26 cm, e.g. 0.8-25 cm, such as 0.9-24 cm, e.g. 1.0-23 cm, such as 1.5-22 cm, such as 2-21 cm, e.g. 3-20 cm, such as 4-19 cm, for example 5-18 cm or 6-17 cm, e.g. 7-16 cm, such as 8-15 cm, for example 9-14 cm, such as 10-13 cm or 11-12 cm.

In one embodiment of the magnet system according to the first aspect of the present disclosure the maximum extension, in a direction parallel to the direction of the magnetic polarity of the magnets of or more of the first, inner annular magnet, the second, inner annular magnet; the first, outer annular magnet; the second, outer annular magnet; the first, inner annular pole piece and/or the first, outer annular pole piece independently is/are selected from the ranges: 0.1-20 cm, such as 0.2-19 cm, e.g. 0.4-18 cm, such as 0.6-17 cm, such as 0.7-16 cm, e.g. 0.8-15 cm, such as 0.9-14 cm, e.g. 1.0-13 cm, such as 1.5-12 cm, such as 2-11 cm, e.g. 3-10 cm, such as 4-9 cm, for example 5-8 cm or 6-7 cm.

Such dimensions are for magnet systems and pole pieces for use as an electromechanical transducer, such as for use in a speaker unit.

In one embodiment of the magnet system according to the first aspect of the present disclosure the one or more of the first, inner annular magnet, the second, inner annular magnet; the first, outer annular magnet; the second, outer annular magnet independently includes an array of separate magnet entities which collectively make up such a magnet; or includes a single coherent magnet entity.

Either of these configurations may equally well be used in the magnet system of the present disclosure.

In one embodiment of the magnet system according to the first aspect of the present disclosure one or more of the first, inner annular pole piece and/or the first outer annular pole piece independently includes an array of separate pole piece entities which collectively make up such a pole piece; or includes a single coherent pole piece entity.

Either of these configurations may equally well be used in the magnet system of the present disclosure.

In one embodiment of the magnet system according to the first aspect of the present disclosure the magnet system, physically and magnetically, is being symmetric in relation to a mirror plane; wherein the mirror plane being perpendicular to the direction of the magnetic polarity of the magnets and is cutting through the first, inner annular pole piece and the first outer annular pole piece.

In one embodiment of the magnet system according to the first aspect of the present disclosure one or both of the magnets of the first magnet system or of the second magnet system, or of one or both of the pole pieces of the first pole piece arrangement independently deviates from having an annular character in that one or more slits are being present in those magnet(s) or pole piece(s).

Each of the slits accordingly will extend through part of the magnet or the pole piece from an outer surface thereof to an inner surface thereof.

Such geometries of the magnets and the pole pieces may satisfactorily be used in the present disclosure in its various aspects.

In one embodiment of the magnet system according to the first aspect of the present disclosure the magnet system furthermore includes:

- a third set of magnets, wherein the third set of magnets includes a third, inner annular magnet and a third outer, annular magnet, wherein the third, inner annular magnet is being arranged within the interior of the third outer, annular magnet; and
- a second pole piece arrangement; wherein the second pole piece arrangement includes a second, inner annular pole piece and a second, outer annular pole piece, wherein the second, inner annular pole piece is being arranged within the interior of the second, outer annular pole piece;
- wherein the second set of magnets are being arranged between the first pole piece arrangement and the second pole piece arrangement; and
- wherein the second pole piece arrangement is being arranged between the second set of magnets and the third set of magnets;
- wherein the magnetic polarity of the third, inner annular magnet is opposite to the magnetic polarity of the second, inner annular magnet; and
- wherein the magnetic polarity of the third, outer annular magnet is opposite to the magnetic polarity of the second, outer annular magnet;
- wherein the third, inner annular magnet and the third outer, annular magnet are having geometries and dimensions so that a third magnet air gap is being present between the third, inner annular magnet and the third outer, annular magnet;
- wherein the second, inner annular pole piece and the second, outer annular pole piece are having geometries and dimensions so that a second pole piece air gap is being present between the second, inner annular pole piece and the second, outer annular pole piece.

In one embodiment of the magnet system according to the first aspect of the present disclosure the features relating to the second, inner annular pole piece and/or the second, outer annular pole piece are as those defined in any of the preceding claims in respect of the first inner annular pole piece and/or the first, outer annular pole piece, respectively.

Whereas the magnet system of the first aspect of the present disclosure in its general form represents a pole piece arrangement being "sandwiched" between two magnet systems, the embodiment described above can be interpreted as a "double sandwich" of magnet systems and pole piece arrangement.

In this embodiment three magnet systems and two pole piece arrangements are present and arranged so that each pole piece arrangement is "sandwiched" between two magnet systems.

Accordingly, it is clear that features relating to the first inner annular pole piece and/or the first, outer annular pole piece, respectively, may apply equally well to the second, inner annular pole piece and/or the second, outer annular pole piece, respectively.

In one embodiment of the magnet system according to the first aspect of the present disclosure the features relating to the third inner, annular magnet (30) and/or the third, outer annular magnet (32) are as those defined in respect of the first inner annular magnet (6) and/or the first, outer annular magnet (8), respectively.

It is clear that features relating to the third inner, annular magnet and/or the third, outer annular magnet respectively, may apply equally well to the those defined in respect of the first inner annular magnet and/or the first, outer annular magnet, respectively.

In one embodiment of the magnet system according to the first aspect of the present disclosure the features relating to mutual relations between the third inner annular magnet, the third outer annular magnet, the second, inner annular pole piece and the second outer annular pole piece, respectively, corresponds to those features relating to mutual relations, as defined in any of the preceding claims, between the first, inner annular magnet, the first outer annular magnet, the first, inner annular pole piece and the first outer annular pole piece, respectively.

Again, due to the symmetric nature of the magnet system, it is clear that these similarities may apply.

In one embodiment of the magnet system according to the first aspect of the present disclosure the magnet system, physically but not necessarily magnetically, is being symmetrical in relation to a mirror plane; said mirror plane being perpendicular to the direction of the magnetic polarity of the magnets, is cutting through the second, inner annular magnet and the second, outer annular magnet.

The Second Aspect of the Present Disclosure

In a second aspect the present disclosure related to an electromechanical transducer including a magnet system according to the first aspect of the present disclosure in combination with one or more coil(s) of an electrically conducting material, wherein said coil(s) is/are being arranged in one or more of the first pole piece air gap and optionally also in the second pole piece air gap, if present, of said magnet system.

In one embodiment of the electromechanical transducer according to the second aspect of the present disclosure the coil(s) is/are arranged around a tubular coil former, wherein said tubular coil former is being arranged at least partly in one or more of said first magnet air gap, said second magnet air gap, said first pole piece air gap; and optionally also in said third magnet air gap and/or in said second pole piece air gap.

A coil former provides for guiding the position of the coil in the air gap, thereby aiding in avoiding that the coil(s) move(s) in a radial direction.

The Third Aspect of the Present Disclosure

In a third aspect the present disclosure relates to a speaker unit including an electromechanical transducer according to the second aspect of the disclosure and furthermore including a diaphragm, wherein said diaphragm is mechanically coupled to said coil(s).

In one embodiment of the speaker unit according to the third aspect of the present disclosure the unit including a chassis, wherein the magnet system is being fixed to that chassis, and wherein the diaphragm is being mechanically coupled to the chassis, such as at an outer perimeter of the diaphragm; and wherein the diaphragm, at a distance from the outer perimeter, is being mechanically coupled to the coils, such as via a spider.

Referring to the figure in order to better illustrating the present disclosure, FIG. 1 is a cross-sectional view of a typical prior art magnet system for an acoustic driver.

FIG. 1 shows the prior magnet system 200 including a T-yoke 202, a top plate 208 and an annular magnet 210. All the elements making up the prior art magnet system 200 is having a rotational symmetry around the axial axis R.

The T-yoke includes a base plate 204 and an axial extension 206. The annular magnet 210 is coaxially arranged around the axial extension 206 of the T-yoke and the top plate 208 is arranged on top of the annular magnet 210. The top plate is including a center hole 214 which has a larger diameter than the diameter of the axial extension 206 of the T-yoke 202. This leaves an air gap 212 between the top plate and the upper portion of the T-yoke extension 206 of the T-yoke.

The polarity of the annular magnet 210 is directed in an axial direction as shown.

The magnet flux density radiates from the north pole N of the magnet 210 to the top plate where it changes direction and crosses the air gap to the upper portion of the axial extension 206 of the T-yoke 202, from where it continues axially through the axial extension 206 and enters the base plate 202 and extends into the south pole of the magnet 210.

The air gap 212 is intended for accommodating a voice coil which is to be connected to a diaphragm of the acoustic driver.

It can be seen in FIG. 1 that from a given rest point of a voice coil accommodated in the air gap 212 the geometry of the magnet system is different in moving in one axial direction in the air gap, compared to a situation in which the voice coil moves in the opposite axial direction.

Such an asymmetry of the air gap of the prior art magnet system has the consequence that a corresponding asymmetric magnetic flux density is encountered by a voice coil accommodated in the air gap, and this in turn will lead to various types of distorted response of the voice coil in relation to an electric signal supplied thereto. Moreover, such asymmetric magnetic flux density in the air gap will lead to a non-linearity in the voice coil response.

In more detail this can be explained as follows. For a given frequency supplied to the voice coil being accommodated in the air gap surrounding the axial extension 206 of the T-yoke of the magnet system of a prior art speaker unit, the current flowing in the coil will depend on the axial position of the voice coil (because the inductance decreases when the voice coil is arranged in the air gap, compared to a situation where part of the voice coil has moved out of the air gap). This will lead to a non-linear response of the movement of the voice coil, because the force exerted on the voice coil and originating from the induction taking place will depend on the current flowing in the voice coil.

Moreover, when the voice coil is moving axially back and forth in the air gap, it will in extreme positions, in which part of the coil approaches or event leaves the air gap, experience different magnetic flux geometries (due to the non-symmetric geometry of the T-yoke magnet system) in the two opposite, extreme positions. This will have as a consequence that when an electrical signal which is symmetric, such as a sine curve is provided to the voice coil the mechanical response of the voice coil which translates into sound waves having an amplitude curve which has lost its symmetry due to the non-symmetric flux encountered by the voice coil at the two opposite extreme positions of the voice coil in the air gap. Accordingly, this represents a distortion of the symmetrical electric signal.

Obviously, also a non-symmetric signal being supplied to the voice coil of the prior art will imply same type of distortion when it is translated into sound waves by the speaker unit including the same type of T-yoke magnet system.

Accordingly, the prior art magnet system including a T-yoke, an annular magnet and a top plate represent certain disadvantages, which the present disclosure seeks to solve.

Figure 2A:
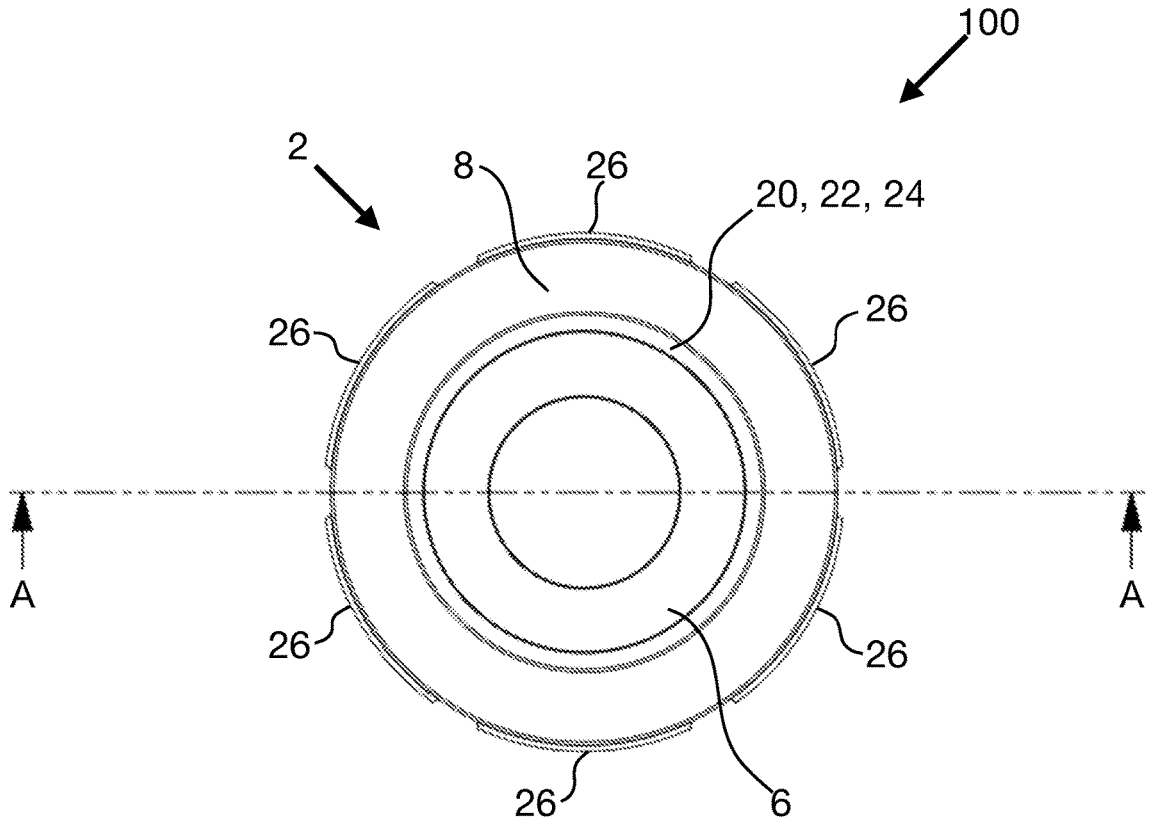
FIG. 2*a* is a plan view showing one embodiment of a magnet system according to the first aspect of the present disclosure including two sets of magnets and one pole piece arrangement.

FIG. 2*a* is a plan view illustrating a magnet system of the first aspect of the present disclosure.

FIG. 2*a* shows the magnet system 100 for an electromechanical transducer, including a first, inner annular magnet 6 and a first, outer annular magnet 8. The first, inner annular magnet 6 is arranged within the first, outer annular magnet 8.

The first, inner annular magnet 6 and the first, outer annular magnet 8 make up a first set of magnets 2. Behind the first set of magnets 2 are arranged a first pole piece arrangement 14 and a second set of magnets 4 (these parts are not seen in FIG. 2*a*).

It is seen in FIG. 2*a* that a first magnet air gap 20 is arranged between the first, inner annular magnet 6 and the first, outer annular magnet 8. The air gap 20 extends into a second magnet air gap 22 (between two magnets making up the second set of magnets) and into a first pole piece air gap 24 (between two pole pieces making up the first pole piece arrangement).

Figure 2B:
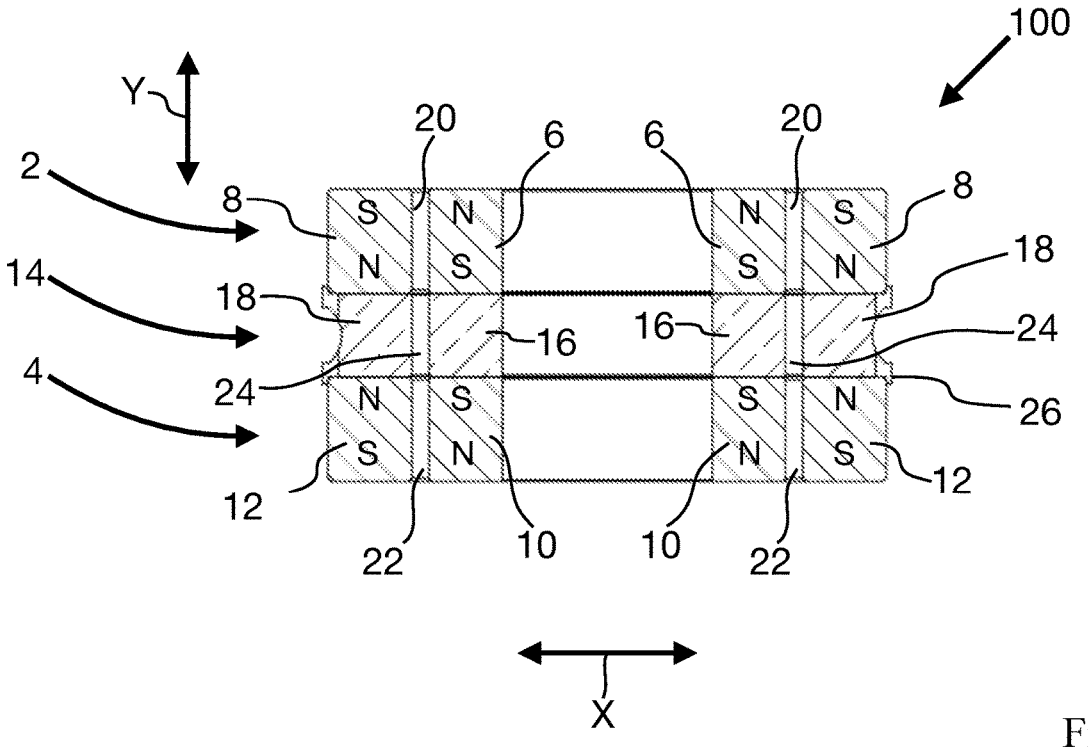
FIG. 2*b* is a cross-sectional view illustrating the magnet system of FIG. 2*a*.

FIG. 2*b* is a cross sectional view illustrating the magnet system of FIG. 2*a* as seen through the cut A-A.

FIG. 2*b* shows the magnet system 100 includes a first set 2 of magnets and a second set 4 of magnets and including a first pole piece arrangement 14.

The first set 2 of magnets includes a first, inner annular magnet 6 and a first outer, annular magnet 8.

Likewise, the second set 4 of magnets includes a second, inner annular magnet 10 and a second, outer annular magnet 12.

It is seen in FIG. 2*b* that the first, inner annular magnet 6 is arranged in the interior of said first outer annular magnet 8, and that the second inner annular magnet 10 is arranged in the interior of said second outer annular magnet 12.

FIG. 2*b* also shows the magnetic polarity of the magnets of the first and second set 2,4 of the magnets involved.

Accordingly, the magnetic polarity in respect of the first, inner annular magnet 6, the first outer, annular magnet 8, the second, inner annular magnet 10 and of the second, outer annular magnet 12 is having a direction Y corresponding to a direction perpendicular to the annular extension X of the magnets. That is, the magnetic polarity is directed in an axial direction.

As mentioned, the magnet system also includes a first pole piece arrangement 14.

The first pole piece arrangement 14 includes a first, inner annular pole piece 16 and a first, outer annular pole piece 18, wherein the first, inner annular pole piece 16 is arranged within the interior of the first, outer annular pole piece 18.

Moreover, it is seen in FIG. 2*b* that the first pole piece arrangement 14 is being arranged between the first set of magnets 2 and said second set of magnets 4.

The magnetic polarity of the first, inner annular magnet 6 is opposite to the magnetic polarity of the first, outer annular magnet 8; the magnetic polarity of the first, inner annular magnet 6 is opposite to the magnetic polarity of the second, inner annular magnet 10; and the magnetic polarity of the first, outer annular magnet 8 is opposite to the magnetic polarity of the second, outer annular magnet 12.

Hereby also the magnetic polarity of the second, inner annular magnet 10 will be opposite to the magnetic polarity of the second, outer annular magnet 12.

It is clear that an opposite magnetic polarity in respect of each of the magnets illustrated in FIG. 2*b* could equally well be applied.

It is seen in FIG. 2*b* that the first, inner annular magnet 6 and the first outer, annular magnet 8 are having geometries and dimensions so that a first magnet air gap 20 is being present between the first, inner annular magnet 6 and said first outer, annular magnet 8

Likewise, the second, inner annular magnet 10 and said second outer, annular magnet 12 are having geometries and dimensions so that a second magnet air gap 22 is being present between the second, inner annular magnet 10 and the second outer, annular magnet 12.

Moreover, the first, inner annular pole piece 16 and said first, outer annular pole piece 18 are having geometries and dimensions so that a first pole piece air gap 24 is being present between the first, inner annular pole piece 16 and the first, outer annular pole piece 18.

Mounting guides 26 have been provided during the assembly of the elements making up the magnet system, The air gap 24 arranged between the first inner annular pole piece 16 and the first outer, annular pole piece 18 provides for accommodation of a coil of an electrically conducting material, thereby leading to an electromechanical transducer.

It is seen in FIG. 2*b* that when accommodating a coil, such as a voice coil, in the first pole piece air gap 24, that coil will encounter the same magnetic properties, originating from the four magnets 6,8,10,12, in that air gap when moving in an axial direction in either of the two axial direction because the magnet system is fully symmetrical around a mirror plane cutting through the first pole piece arrangement.

Such symmetry of magnetic properties in the axial direction of an air gap of an electrodynamic transducer is highly desirable when used as an acoustic driver.

Figure 4:
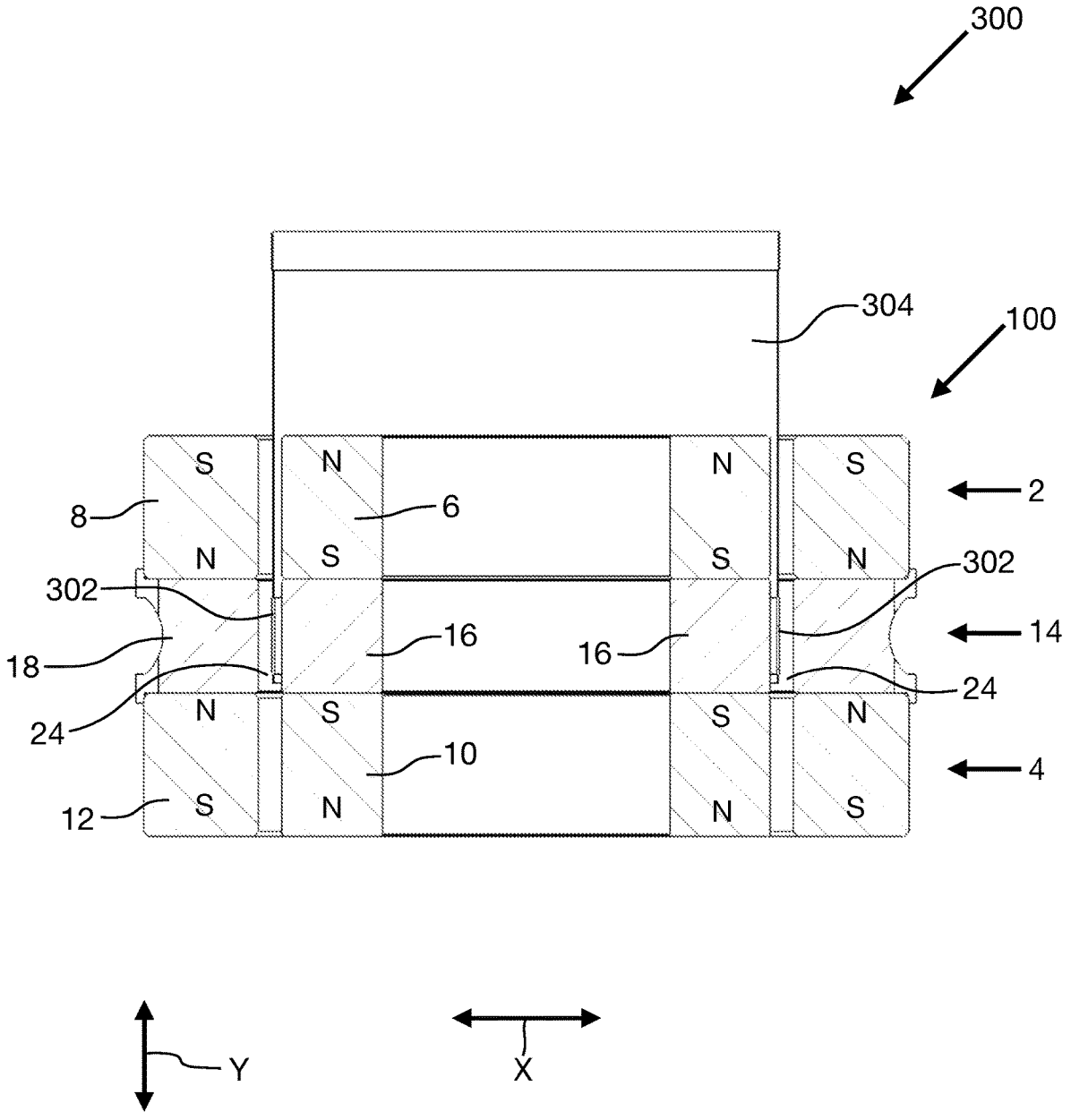
FIG. 4 is a cross sectional view illustrating an electromechanical transducer according to the second aspect of the present disclosure and including the magnet system of FIG. 2*b*.

FIG. 4 is a cross-sectional view illustrating an electrodynamic transducer according to the second aspect of the present disclosure.

FIG. 4 shows the electrodynamic transducer 300 including a magnetic system 100 as illustrated in FIG. 2*b*. The magnet system 100 is provided with a coil 302 of an electrically conducting material arranged in the air gap 24 located between the first inner annular pole piece 16 and the first outer, annular pole piece 18.

FIG. 4 shows that the coil 302 has been wound on a coil former 304 for supporting the coil 302.

In case the coil former 304 is being connected to a diaphragm a speaker unit is formed. This is illustrated in FIG. 6.

Figure 6:
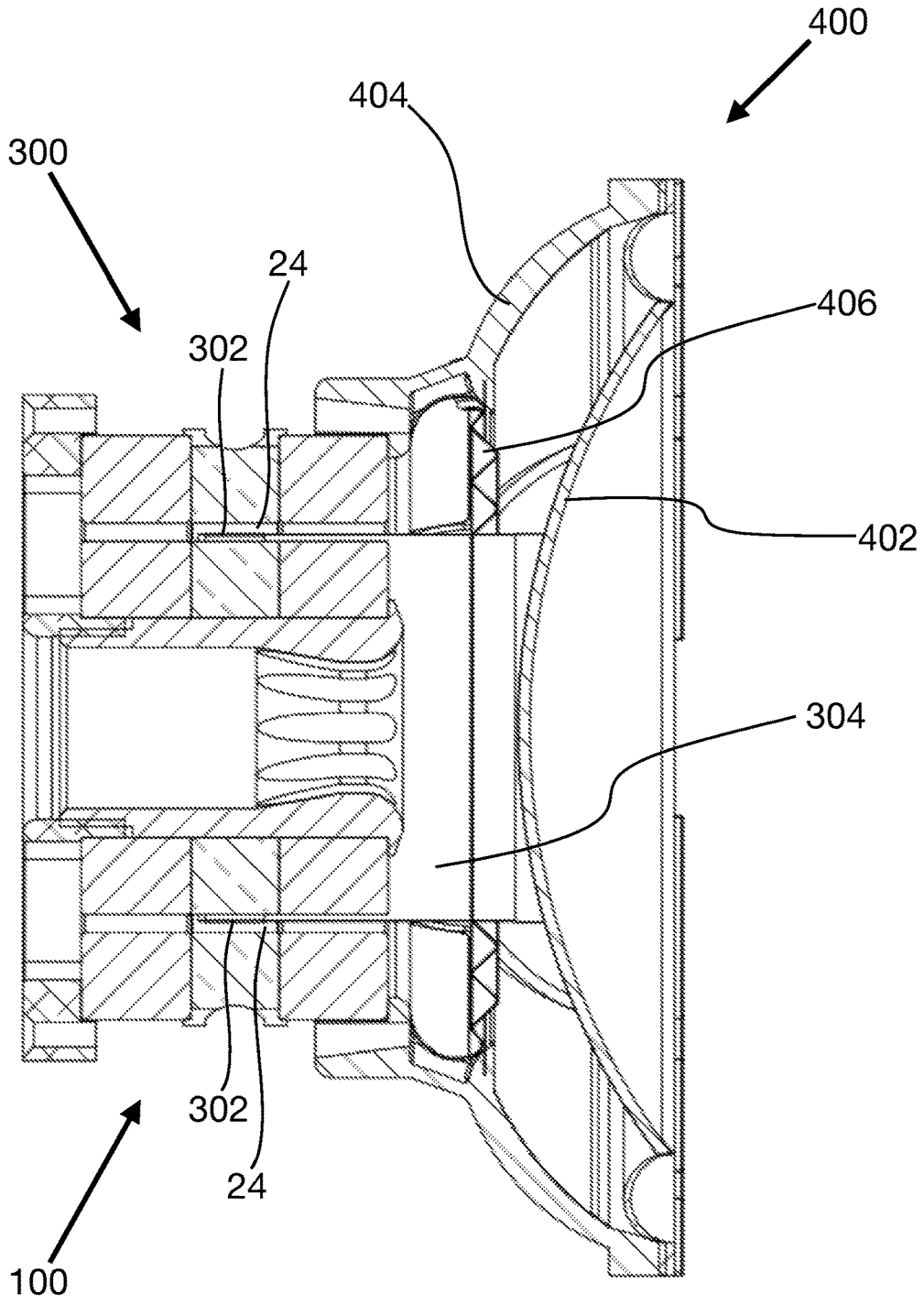
FIG. 6 is a cross-sectional view illustrating a speaker unit including the electromechanical transducer illustrated in FIG. 4.

FIG. 6 is a cross-sectional view illustrating a speaker unit according to the third aspect of the present disclosure.

FIG. 6 shows the speaker unit 400 including the electrodynamic transducer 300 of FIG. 4 which in turn includes the magnet system 100. The magnet system 100 of the speaker is fastened to a chassis 404 onto which the diaphragm 402 is suspended at an outer perimeter thereof. The coil former 304 of the electrodynamic transducer 300 is attached to the back side of the diaphragm 402 via the spider 306, thereby forming a speaker unit, such as a woofer.

Figure 3:
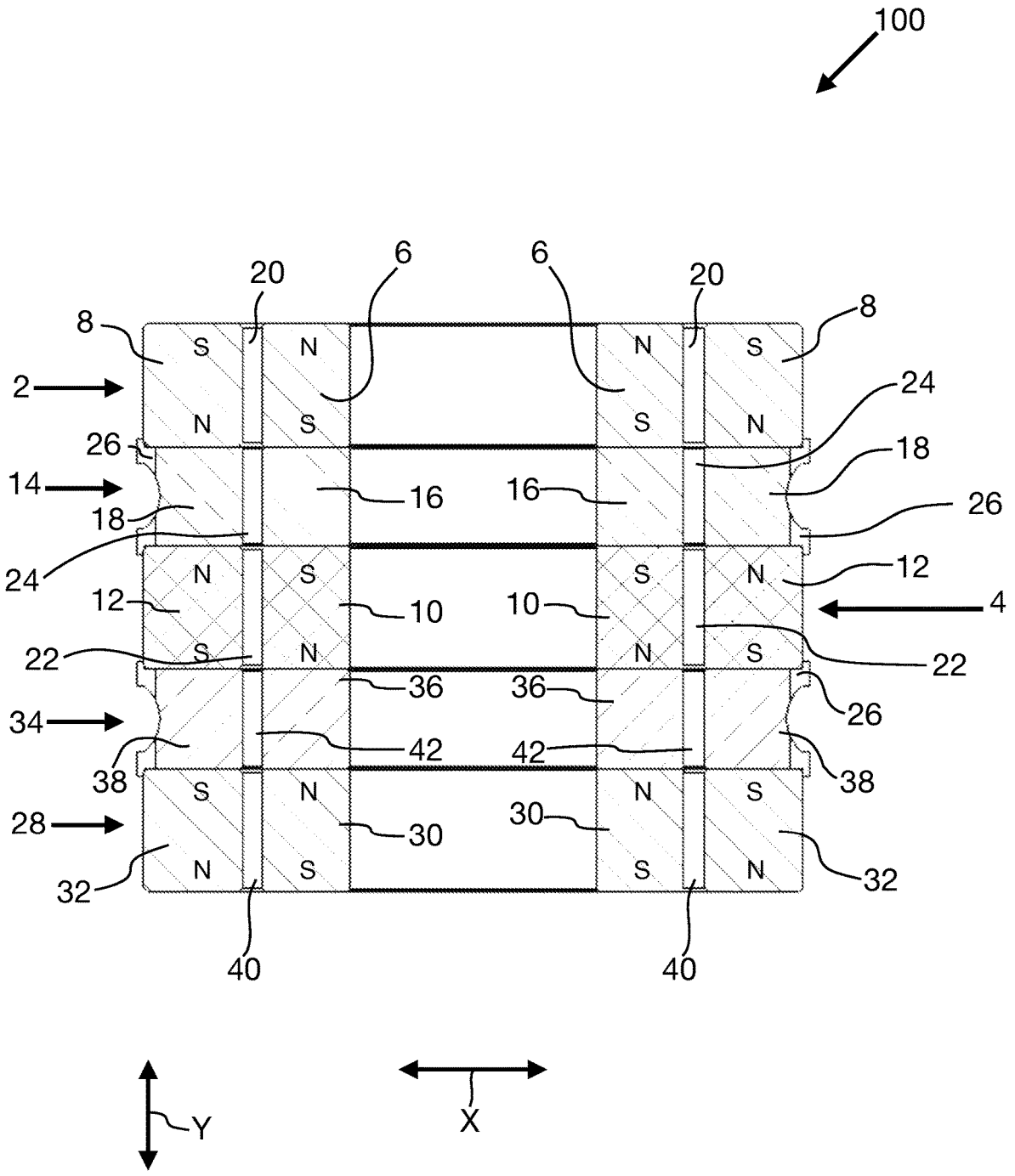
FIG. 3 is a cross-sectional view illustrating another embodiment of a magnet system according to the first aspect of the present disclosure including three sets of magnets and two pole piece arrangements.

FIG. 3 is a cross section illustrating an alternative embodiment of the magnet system of the first aspect of the present disclosure.

FIG. 3 shows the magnet system 100. The upper part of the magnet system illustrated in FIG. 3 including the first set 2 of magnets, the second set 4 of magnets and the first pole piece arrangement 14 is identical to the magnet system illustrated in FIG. 2*b*.

In addition to these parts, the magnet system 100 illustrated in FIG. 3 includes a third set of magnets 28 including a third, inner annular magnet 30 and a third outer, annular magnet 32, wherein the third, inner annular magnet 30 is being arranged within the interior of the third outer, annular magnet 32.

Moreover, it is seen in FIG. 3 that the magnet system 100 includes a second pole piece arrangement 34 including a second, inner annular pole piece 36 and a second, outer annular pole piece 38, wherein the second, inner annular pole piece 36 is being arranged within the interior of said second, outer annular pole piece 38.

The second set of magnets 4 are being arranged between the first pole piece arrangement 14 and the second pole piece arrangement 34; and the second pole piece arrangement 34 is being arranged between the second set of magnets 4 and the third set of magnets 28.

The magnetic polarity of the third, inner annular magnet 30 is opposite to the magnetic polarity of said second, inner annular magnet 10; and the magnetic polarity of the third, outer annular magnet 32 is opposite to the magnetic polarity of the second, outer annular magnet 12.

The third, inner annular magnet 30 and the third outer, annular magnet 32 are having geometries and dimensions so that a third magnet air gap 40 is being present between the third, inner annular magnet 30 and the third outer, annular magnet 32.

Likewise, the second, inner annular pole piece 36 and the second, outer annular pole piece 38 are having geometries and dimensions so that a second pole piece air gap 46 is being present between the second, inner annular pole piece 36 and said second, outer annular pole piece 38.

The air gap 24 arranged between the first inner annular pole piece 16 and the first outer, annular pole piece 18 on the one hand; and the air gap 42 arranged between the second inner annular pole piece 36 and the second outer, annular pole piece 32 on the one hand provide for accommodation of two coils of an electrically conducting material, thereby leading to an electromechanical transducer.

It is seen in FIG. 3 that when accommodating a first coil, such as a voice coil, in the first pole piece air gap 24, and a second coil in the second air gap 42 these two coils will collectively encounter the same magnetic properties, originating from the six magnets 6,8,10,12,30,32 in these two air gaps 24 and 42 when moving in an axial direction in either of the two axial direction because the magnet system is fully physical symmetrical around a mirror plane cutting through the second set of magnets 4.

Such symmetry of magnetic properties in the axial direction of air gaps of an electrodynamic transducer is highly desirable when used as an acoustic driver.

Figure 5:
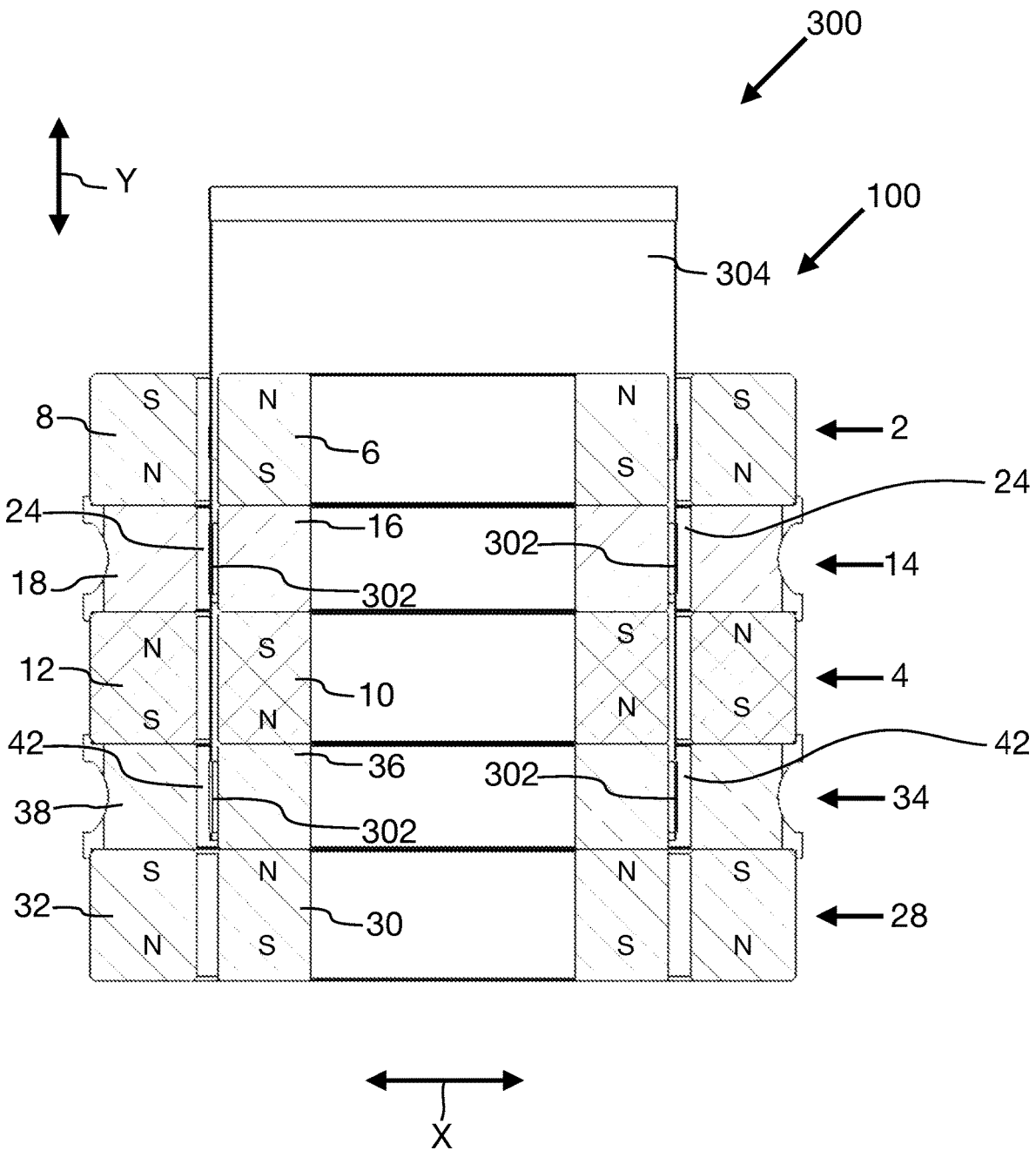
FIG. 5 is a cross sectional view illustrating an electromechanical transducer according to the second aspect of the present disclosure and including the magnet system of FIG. 3.

FIG. 5 is a cross-sectional view illustrating an electrodynamic transducer according to the second aspect of the present disclosure.

FIG. 5 shows the electrodynamic transducer 300 including a magnetic system 100 as illustrated in FIG. 3. The magnet system 100 is provided with a first coil 302 of an electrically conducting material arranged in the air gap 24 located between the first, inner annular pole piece 16 and the first, outer annular pole piece 18.

The magnet system 100 is moreover provided with a second coil 302 of an electrically conducting material arranged in the air gap 42 located between the second, inner annular pole piece 36 and the second, outer annular pole piece 38.

Obviously, the phase of the electrical signal supplied to the first coil 302 and the second coil 302, respectively is selected so that the two coils will be moving in concert in the same direction rather than moving in opposite direction in the air gaps 24 and 42 respectively.

The two coils 302 have been wound on a coil former 304 for supporting the coil 302.

EXAMPLES

Example 1—Concentrating Magnetic Flux Density in Air Gap

This example illustrates the ability of the magnet system according to the first aspect of the present disclosure to provide a considerably increased magnetic flux density in the air gap between the two pole pieces of the first pole piece arrangement.

Four magnets were used for designing a magnet system according to the first aspect of the present disclosure.

Each magnet was of the neodymium-iron-boron type. Each of the four magnets had a cylindrical inner surface and a cylindrical outer surface of circular cross-sections. The magnetic polarity of each magnet was aligned in the axial direction.

The dimensions of the magnets were as follows:

The first and second, inner annular magnet had an inner diameter of 30 mm and an outer diameter of 50 mm. The axial extension of these magnets was 15 mm.

The first and second, outer annular magnet had an outer diameter of 80 mm and an inner diameter of 56 mm. The axial extension of these magnets was 15 mm.

The first inner and first outer pole piece had radial dimensions corresponding to the magnets and had an axial extension of 12 mm. The pole pieces were made of copper.

Using a probe (Gauss/Teslameter: BST BST600 Gaussmeter), the magnetic flux density was measured at the surface of the pole of the magnets. The magnetic flux density was measured to be 0.35 Tesla.

A magnet system having a geometry according to the first aspect of the present disclosure was manufactured by assembling the four magnets and the two pole pieces into a magnet system entity. The structure of the resulting magnet system was as depicted in FIGS. 2*a* and 2*b*.

The same probe was used for measuring the magnetic flux density in the first pole piece air gap (i.e. the air gap being present between the first, inner pole piece and the first outer pole piece). The magnetic flux density was measured to be 1.2 Tesla in this air gap.

Accordingly, in the magnet system of the present disclosure, the magnetic flux density has been concentrated into the first pole piece air gap, compared to the magnetic flux density at the surface of the pole of the magnet of a factor>3.4.

A high flux density in the air gap of a magnet system provides for a high efficiency of an electromechanical transducer.

Moreover, in contrast to the prior art magnet systems including a T-yoke, an annular magnet and a top plate, the magnet system according to the first aspect of the present disclosure ensures that the magnetic flux variation when moving in an out of the air gap between the pole pieces of the first pole piece arrangement is symmetrical in the two axial directions.

Hereby, any undesirably properties caused by effects relating to unsymmetrical border conditions at the extreme outer positions of the air gap and the magnetic flux present therein is reduced.

This is highly appreciated when the magnet system is used in an acoustic driver for a loudspeaker.

Example 2—Obtaining an Unprecedented Low Inductance in a Coil Arranged in the Pole Piece Air Gap of the Inventive Magnet System In the magnet system according to the present disclosure described in Example 1 above, a coil was arranged at a center position in the axial direction of the first pole piece air gap.

The specifications of the coil were as follows:

The coil was cylindrical with a circular cross-section and was wound with copper clad wire having a diameter of 0.2 mm. The coil includes an inner coil and an outer coil. The total number of windings were 40.

The inductance of the coil in free air was, using a DATS V2 computer program, measured to be 0.45 mH.

Subsequently, the coil was arranged concentrically in the first pole piece air gap of the magnet system described in Example 1 in order to obtain an electromechanical transducer according to the second aspect of the present disclosure.

Using the same DATS V2 computer program with the same settings, the inductance was now measured to 0.05 mH.

In case the electromechanical transducer is to be used as a speaker unit, such as a driver for a loudspeaker, this low inductance of the coil is highly desirable.

The low inductance obtained implies that the coil is capable of responding to an electrical signal supplied to it a faster rate with reduced lag, thus leading to a more detailed presentation of the sound generated by the speaker.

Additionally, the very low inductance also implies lower resonance impedance variation, which in turn results in lower phase angles and impedance variation for the amplifier driving the speaker.

The inventor of the present disclosure is not aware of prior art speaker units of similar physical specifications which are having such as low inductance. Rather, to the best of the inventor's knowledge all prior art speakers of similar physical specifications are having an inductance which is higher by around a factor 10.

Another advantage of the inventive magnet system, when used in a speaker unit, is the possibility of manufacturing the inner and outer annular pole pieces of a material having a high thermal conductivity, such as copper or an copper alloy, or silver. Thereby any heat dissipated in the coil accommodated in pole piece air gap can be efficiently be removed.

As the inner and outer annular pole pieces can be designed with a considerably physical extension in an axial direction and in a direction perpendicular thereto, thereby including a considerably mass of a relatively good thermal conductor, very efficient heat sinking properties can be provided to the speaker unit.

According, in high end audio applications, in which sound quality is of primary importance and in which manufacturing price is secondary, the present disclosure in its various aspect presents a wide variety of advantages.

It should be understood that all features and achievements discussed above and in the appended claims in relation to one aspect of the present disclosure and embodiments thereof apply equally well to the other aspects of the present disclosure and embodiments thereof.

LIST OF REFERENCE NUMERALS

2 First set of magnets
4 Second set of magnets
6 First, inner annular magnet
8 First, outer annular magnet
10 Second, inner annular magnet
12 Second, outer annular magnet
14 First pole piece arrangement
16 First, inner pole piece
18 First, outer pole piece
20 First magnet air gap
22 Second magnet air gap
24 First pole piece air gap
26 Mounting guide
28 Third set of magnets
30 Third inner, annular magnet
32 Third outer, annular magnet
34 Second pole piece arrangement
36 Second inner annular pole piece
38 Second outer annular pole piece
40 Third magnet air gap
42 Second pole piece air gap
100 Magnet system according to the present disclosure
200 Magnet system according to the prior art
202 T-yoke of prior art magnet system
204 Base plate of T-yoke
206 Center extension of T-yoke
208 Top plate of prior art magnet system
210 Annular magnet of prior art magnet system
212 Air gap for voice coil between top plate and center extension
214 Center hole in top plate
300 Electromechanical transducer according to the present disclosure
302 Coil of electrically conduction material
304 Coil former for supporting coil
400 Speaker unit
402 Diaphragm
404 Chassis of speaker unit
406 Spider of speaker unit
N North pole of magnetic polarity
R Rotational axis of symmetry
S South pole of magnetic polarity
X Direction parallel to magnetic polarity of magnets
Y Direction perpendicular to annular extension of annular magnets That which is claimed is:

1. A magnet system for an electromechanical transducer, said magnet system comprising:

a first set of magnets and a second set of magnets;

wherein said first set of magnets comprises a first inner annular magnet and a first outer annular magnet;

wherein said second set of magnets comprises a second inner annular magnet and a second outer annular magnet;

wherein said first inner annular magnet is arranged in the interior of said first outer annular magnet;

wherein said second inner annular magnet is arranged in the interior of said second outer annular magnet;

wherein the magnetic polarity of said first inner annular magnet, said first outer annular magnet, said second inner annular magnet, and of said second outer annular magnet has a direction (Y) corresponding to a direction perpendicular to an annular extension of said magnets;

a first pole piece arrangement, said first pole piece arrangement comprising a first inner annular pole piece and a first outer annular pole piece, wherein said first inner annular pole piece is arranged within the interior of said first outer annular pole piece;

wherein said first pole piece arrangement is arranged between said first set of magnets and said second set of magnets;

wherein the magnetic polarity of said first inner annular magnet is opposite to the magnetic polarity of said first outer annular magnet;

wherein the magnetic polarity of said first inner annular magnet is opposite to the magnetic polarity of said second inner annular magnet;

wherein the magnetic polarity of said first outer annular magnet is opposite to the magnetic polarity of said second outer annular magnet; and wherein said first inner annular magnet and said first outer annular magnet have geometries and dimensions so that a first magnet air gap is present between said first inner annular magnet and said first outer annular magnet; and/or said second inner annular magnet and said second outer annular magnet have geometries and dimensions so that a second magnet air gap is present between said second inner annular magnet and said second, outer annular magnet; and/or said said first inner annular pole piece and said first outer annular pole piece have geometries and dimensions so that a first pole piece air gap is present between said first inner annular pole piece and said first outer annular pole piece; and wherein said first inner pole piece and said first outer pole piece are made from a non-ferromagnetic material.

2. A magnet system according to claim 1, wherein two or more of said first magnet air gap, said second magnet air gap, and said first pole piece air gap independently has an extension, in a direction (X) perpendicular to a direction (Y) of said magnetic polarities, of equal magnitude.

3. A magnet system according to claim 1, further comprising:

means for fixing, relative to each other, said first inner annular magnet, said first outer annular magnet, said second inner annular magnet, said second outer annular magnet, said first inner annular pole piece, and said first outer annular pole piece, wherein said means for fixing optionally comprises bolts, nuts, bushings, and/or glue.

4. A magnet system according to claim 1, wherein said first inner annular pole piece and said first outer annular pole piece independently are made from a non-ferromagnetic metal or alloy, optionally copper, aluminium, or silver, or from an alloy thereof, optionally bronze or brass.

5. A magnet system according to claim 1, wherein said first inner annular magnet, said second inner annular magnet, and said first inner annular pole piece each independently comprises a cylindrical inner surface and/or a cylindrical outer surface.

6. A magnet system according to claim 1, wherein said first outer annular magnet, said second outer annular magnet, and said first outer annular pole piece each independently comprises a cylindrical inner surface and/or a cylindrical outer surface.

7. A magnet system according to claim 1, wherein:

said first inner annular magnet is concentrically arranged within said first outer annular magnet; and/or said second inner annular magnet is concentrically arranged within said second outer annular magnet; and/or said first inner annular pole piece is concentrically arranged within said first outer annular pole piece.

8. A magnet system according to claim 1, wherein one or more of said first inner annular magnet, said second inner annular magnet, said first outer annular magnet, and said second outer annular magnet independently comprises an array of separate magnet entities which collectively make up such a magnet, or comprises a single coherent magnet entity.

9. A magnet system according to claim 1, wherein of one or more of said first inner annular pole piece and/or said first outer annular pole piece independently comprises an array of separate pole piece entities which collectively make up such a pole piece, or comprises a single coherent pole piece entity.

10. A magnet system according to claim 1, wherein said magnet system, physically and magnetically, is symmetric in relation to a mirror plane, said mirror plane being perpendicular to a direction (Y) of the magnetic polarity of said magnets and is cut through said first inner annular pole piece and said first outer annular pole piece.

11. A magnet system according to claim 1, wherein one or both of the magnets of the first set of magnets or of the second set of magnets, or of one or both of the pole pieces of the first pole piece arrangement, comprises one or more slits.

12. A magnet system according to claim 1, further comprising:

a third set of magnets, wherein said third set of magnets comprises a third inner annular magnet and a third outer annular magnet, wherein said third inner annular magnet is arranged within the interior of said third outer annular magnet; and a second pole piece arrangement, said second pole piece arrangement comprising a second inner annular pole piece and a second outer annular pole piece, wherein said second inner annular pole piece is arranged within the interior of said second outer annular pole piece;

wherein said second set of magnets are arranged between said first pole piece arrangement and said second pole piece arrangement;

wherein said second pole piece arrangement is arranged between said second set of magnets and said third set of magnets;

wherein the magnetic polarity of said third inner annular magnet is opposite to the magnetic polarity of said second inner annular magnet;

wherein the magnetic polarity of said third outer annular magnet is opposite to the magnetic polarity of said second outer annular magnet;

wherein said third inner annular magnet and said third outer annular magnet have geometries and dimensions so that a third magnet air gap is present between said third inner annular magnet and said third outer annular magnet;

wherein said second inner annular pole piece and said second outer annular pole piece have geometries and dimensions so that a second pole piece air gap is present between said second inner annular pole piece and said second outer annular pole piece.

13. A magnet system according to claim 12, wherein said magnet system, physically but not necessarily magnetically, is symmetrical in relation to a mirror plane, said mirror plane being perpendicular to a direction (Y) of the magnetic polarity of the magnets and cuts through the second inner annular magnet and the second outer annular magnet.

14. An electromechanical transducer comprising:

a magnet system according to claim 1; and one or more coils formed of an electrically conducting material, wherein said one or more coils is arranged in at least the first pole piece air gap and optionally also in the second pole piece air gap.

15. An electromechanical transducer according to claim 14, further comprising:

a tubular coil former;

wherein said one or more coils is arranged around said tubular coil former;

wherein said tubular coil former is arranged at least partly in one or more of said first magnet air gap, said second magnet air gap, and said first pole piece air gap, and optionally also in said third magnet air gap and optionally in said second pole piece air gap.

16. A speaker unit comprising:

an electromechanical transducer according to claim 15; and a diaphragm, wherein said diaphragm is mechanically coupled to said one or more coils.

17. A speaker unit according to claim 16, further comprising:

a chassis, wherein said magnet system is fixed to said chassis;

wherein said diaphragm is mechanically coupled to said chassis; and wherein said diaphragm at a distance from said outer perimeter is mechanically coupled to said coil(s).

* * * * *